US006000540A

United States Patent [19]

Larson

[11] Patent Number: 6,000,540

[45] Date of Patent: Dec. 14, 1999

[54] STORAGE BOX FOR TUBULAR CONTAINERS

[76] Inventor: Kevin L. Larson, 518 N. Tenth Ave., Arcadia, Fla. 34266

[21] Appl. No.: 09/127,421

[22] Filed: Jul. 31, 1998

Related U.S. Application Data

[60] Provisional application No. 60/055,407, Aug. 7, 1994.

[51] Int. Cl.[6] ..... B65D 81/00

[52] U.S. Cl. ..... 206/277; 206/499

[58] Field of Search ..... 206/277, 499, 206/372, 379, 443, 446

[56] References Cited

U.S. PATENT DOCUMENTS 4,130,978 12/1978 Cohen ..... 206/499 X 4,640,418 2/1987 Lowry ..... 206/499

5,004,103 4/1991 Connors et al. ..... 206/372

5,271,520 12/1993 Mc Afee ..... 206/499 X

*Primary Examiner*—Jacob K. Ackun

*Attorney, Agent, or Firm*—Gifford, Krass, Groh, Sprinkle, Anderson & Citkowski, P.C.

[57] ABSTRACT

A container or carrying case for cartridges of viscous material such as caulking compound or adhesive together with a tool or gun for using the cartridges in which the cartridges can be stored in either an open position with the cartridge nozzles pointing upwardly or in a closed position with their nozzles pointing downwardly.

12 Claims, 2 Drawing Sheets

STORAGE BOX FOR TUBULAR CONTAINERS

CROSS-REFERENCE TO RELATED APPLICATIONS

This application claims the benefit of United States Provisional Application having Serial Number 60/055,407 filed Aug. 7, 1997.

BACKGROUND OF THE INVENTION

This invention relates to storage or carrying cases and more particularly to such cases for storing and carrying caulking-type tubular cartridges.

Caulking and other viscous products such as adhesives and sealants are available in cylindrically shaped, tubular containers or cartridges. Such cartridges are provided with a dispensing nozzle at one end and a piston-like, movable wall at the other end. Materials are dispensed from the cartridges by loading the cartridge into a caulking tool or gun, which is used to force the moveable, piston-like wall toward the dispensing nozzle to force the contents of the cartridge from the nozzle.

The transporting of material in tubular containers is a problem for workmen using the materials since a large variety of containers usually are required at a work site and such containers are vulnerable to damage and to leakage of materials from opened and partially used containers or from damaged containers. Also, it usually is necessary that a selection of a large number of different types and of various colors of materials such as caulking, adhesive and sealants be available for ready use. Typically, such cartridges or containers are stored and transported in temporary containers such as corrugated boxes or the like where they are vulnerable to damage and contamination by previously opened or leaking cartridges.

SUMMARY OF THE INVENTION

It is an object of the invention to provide a storage or carrying case for transporting a number of containers or cartridges of caulking, adhesive, sealant or other viscous material in an organized and protected manner.

It is another object of the invention for providing a storage case for storing both unopened and partially used cartridges of materials and making such cartridges easily available for selection and use.

The objects of the invention are attained by a carrying case containing tray members suspended in spaced relationship to the bottom of the carrying case and having a plurality of pairs of aligned holes to form stations to receive and support cartridges of caulking, sealant or adhesive in a selected position with the nozzle of the cartridge pointing either upwardly or downwardly depending upon whether or not the cartridge has been previously opened. Space also is afforded for storing a caulking gun to receive and dispense the contents of the cartridges.

DESCRIPTION OF THE DRAWINGS

A preferred embodiment of the invention is shown in the drawings in which.

DETAILED DESCRIPTION

Figure 3:
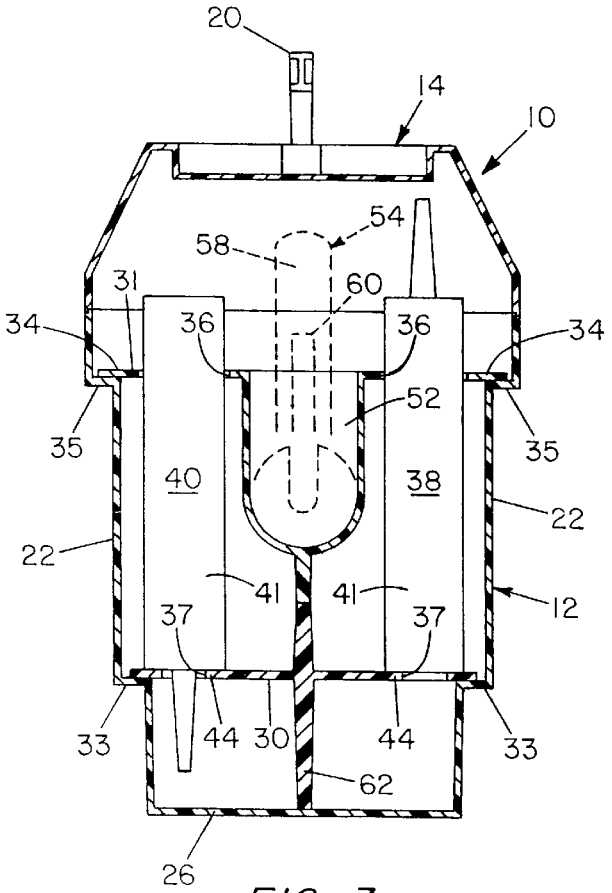
FIG. 3 is a cross-sectional view taken on line 3—3 in FIG. 2.

The caulking cartridge carrying case embodying the invention is designated generally at 10 and includes a base member or compartment 12 and cover member 14 hinged to the base member 12 by hinges indicated at 16 in FIG. 3. A latch 18 keeps the cover member 14 in a closed condition on the base member 12 and a handle 20 on the cover member 14 is used to carry the closed case 10. The base member 12 and cover member 14 can be molded from plastic materials.

The base member 12 is in the form of a rectilinear box having opposed side walls 22, opposed end walls 24 and a bottom wall 26.

A pair of tray member 30 and 31 are removably supported in the base member 12 and can be molded of plastic material. The perimeter of tray 30 forms a flange 32 which is complementary to and rests on a ledge 33 formed in the walls 22 and 24 in spaced relation to the bottom wall 26 of the base member 12 to support the tray member 30 in slightly elevated relation to the bottom wall 26 of the base member 12. Similarily, the tray 31 has a peripheral flange 34 which is complementary to and rests on a ledge 35 formed in the walls 22 and 24 in parallel and spaced relation above the tray 30.

The upper tray 31 is formed with a plurality of holes 36 in uniformly spaced relation extending symmetrically adjacent to each of the side walls 22 of the base member 12. The lower tray 30 is provided with a like number of smaller holes 37, each in axial alignment with a corresponding one of the holes 36 formed in the upper tray 31. The number of pairs of holes 36,37 can vary but a total of twelve of such pairs of holes are illustrated in the drawings. Each of the pairs of aligned holes 36 and 37 form a station for positioning a caulking cartridge such as those indicated at 38 and 40 in FIG. 1 so that the cartridges are positioned with their longitudinal axes extending vertically.

Each of the cartridges 38 and 40 have a tubular body member 41 for holding the contents such as adhesive, caulking, etc. and have a nozzle 42 at one end from which the contents of the tube 41 are dispensed when the cartridge is loaded in a caulking tool or gun.

Figure 1:
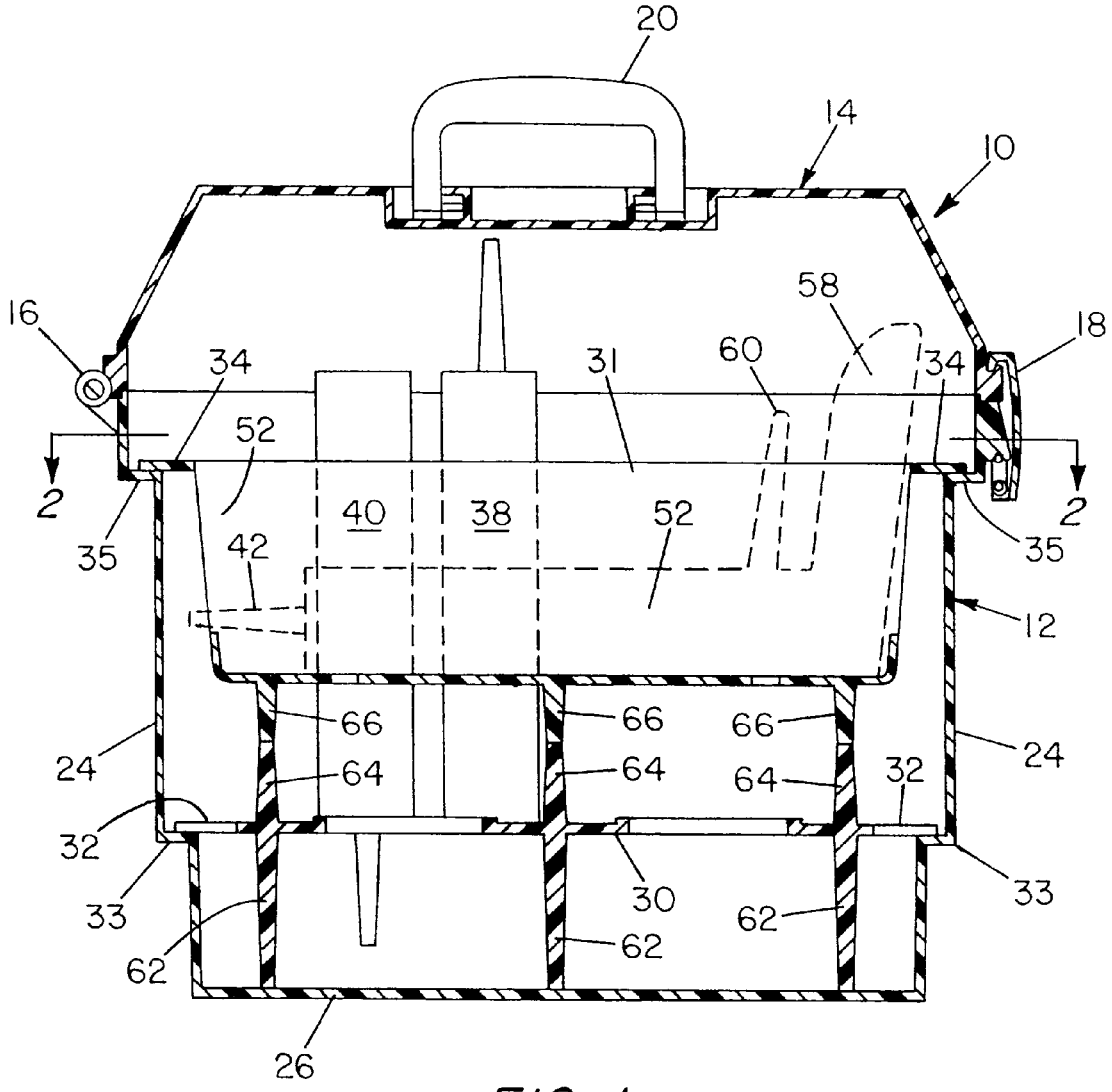
FIG. 1 is a cross-sectional side elevation of the carrying case embodying the invention taken centrally of the case and showing the relative position of opened and unopened cartridges of material and a dispensing gun for dispensing the contents of such cartridges.
Figure 2:
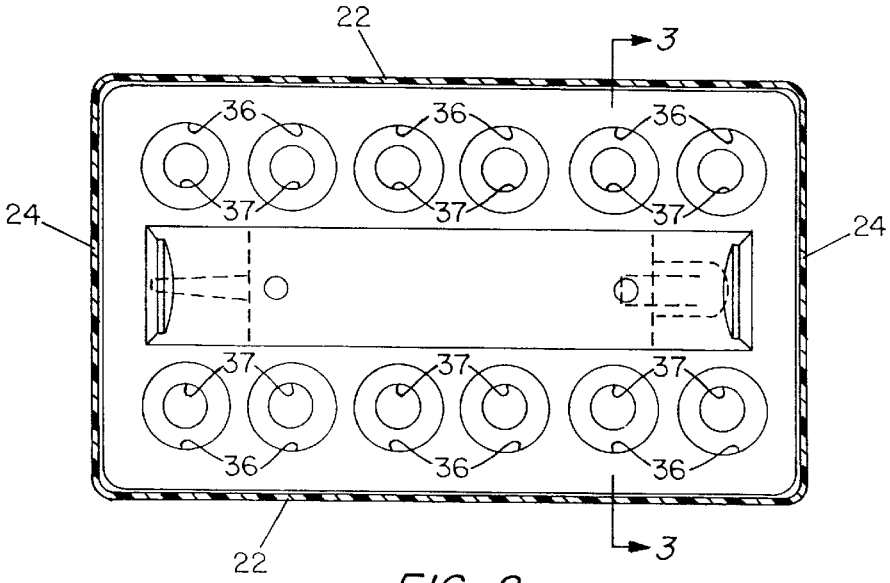
FIG. 2 is a cross-sectional plan view taken on line 2—2 in FIG. 1.

As seen in FIGS. 2 and 3, the holes 36 are sufficiently large to slidably receive the body members 41 and the holes 37 are smaller but sufficiently large to receive the nozzles 42 of cartridges. The bottom tray 30 forms an annular flange 44 around each of the holes 37 so that the flange 44 engages and supports the main body of 41 of a cartridge 40 when a cartridge is positioned with the nozzle 16 pointing downwardly. Similarly, the flange 44 engages and supports the opposite end of the cartridge when positioned with the nozzle 42 pointing upwardly as indicated at 38 in FIG. 1. This makes it possible to insert the cartridges into the cavities 36 so that they have their nozzle 42 pointing upwardly or pointing downwardly. Typically, the unopened cartridges 40 would be positioned with the nozzles 42 pointing downwardly as indicated by cartridge 40 in FIG. 1 and a previously opened and partially used cartridges would be positioned with the nozzles 42 pointing upwardly as depicted by cartridge 38 in FIG. 1. In this way, the viscous material within the cartridges would tend to settle away from the nozzle end of the cartridge and would avoid leakage if the nozzle 42 was left unsealed. In the case of the unopened cartridge 40 with the nozzle 42 pointing downwardly, the contents of the cartridge tend to settle adjacent to the closed nozzle 42 in readiness for dispensing when the cartridge is opened.

To accommodate the downwardly pointing nozzles 42, the tray 30 is suspended within the base member 12 so that the bottom surface 51 of the tray 30 is in spaced relationship to the bottom wall 26 of the base member 12. Any material which might accidentally escape from the cartridges 38 and 40 will leak to the bottom wall of the base member 12 so that it does not contaminate other cartridges and from which it can be removed upon removal of the trays 30 and 31.

The tray 31 has its upper surface positioned so that the upper ends of the main body of each of the cartridges are visible to make it possible to detect the color and to identify the contents of all of the cartridges.

As best seen in FIG. 3, the tray member 30 is provided with a tool receiving cavity 52 which is disposed midway between the side walls 22 of the base member 12 and extends substantially over the entire length of the case 10. The tool receiving cavity 52 is adapted to receive the usual caulking gun indicated in dash lines at 54 in FIGS. 2 and 3. Such caulking guns 54 are well known in the art and typically hold a cartridge 38 or 40 with the cartridge nozzle 42 at one end of the gun 52 as seen in FIG. 1. The opposite end of the gun 54 has a hand grip 58 and trigger 60 which is activated to force contents from a cartridge 38 or 40 loaded in the gun 54.

To support the weight of cartridges 38 and 40 the bottom tray 30 has support legs 62 depending from its bottom to engage the bottom wall 26 of the base member 12. Three of such legs are disposed in spaced relation on a line midway between the side walls 22. Additional support legs 64 project upwardly from the upper surface of tray 30 to engage complementary support legs 66 extending downwardly from the bottom of upper tray 31 and particularly from the portion forming the tool cavity 52. The support legs act to position and support the trays 30 and 31 and the cartridges 38 and 40 and caulking tool 54.

The base member or compartment 12 and its contents are kept covered and protected by cover member 14 which fits closely on the perimeter of the base member. To give access to the compartment interior, the cover swings to one side on its hinges 16. The latch 18 opposite the hinges 16 keeps the cover in a closed position.

A carrying case has been provided for arranging and storing cartridges of material such as caulking, adhesive or sealant in readiness for use and in such a manner that they may be organized for easy visibility to determine their condition, that is, opened or unopened, the color of the contents and the nature of the contents. Also, provision is made for receiving a caulking gun for dispensing the contents of a selected on of the cartridges.

I claim:

1. A container and cartridge combination comprising;

a cartridge having a cylindrical body, an elongated nozzle extending axially from one end of said cylindrical body and having a diameter smaller than said cylindrical body, a container having a base member with opposed parallel side and end walls and a bottom wall, a tray member supported in parallel spaced relation to said bottom wall a distance greater than the length of said nozzle, a plurality of cartridge supporting stations formed in said tray member, an opening formed by said tray at each of said stations and having a diameter smaller than said cylindrical body and larger than said nozzle to slidably receive a dispensing nozzle, and an annular seat portion surrounding said openings to engage a selected end of said cartridge whereby said cartridge can be supported in a selected one of said stations in a selected one of two positions.

2. The combination of claim 1 wherein said stations are disposed in uniformly spaced relation adjacent to each of said sidewalls.

3. The combination of claim 1 wherein said tray member is removable from said base member.

4. The combination of claim 1 and further comprising an additional tray member supported in said base member in parallel spaced relation to said first mentioned tray member and forming a plurality of openings adapted to receive said cylindrical body when said cartridge is in either of said selected positions.

5. The combination of claim 4 and further comprising support legs extending from each of said trays and engaging each other to maintain said tray in spaced relation to each other.

6. The combination of claim 4 wherein said additional tray member is removable from said base member.

7. The combination of claim 4 and further comprising a tool carrying compartment formed in said additional tray member.

8. The combination of claim 7 wherein said tool carrying compartment extends parallel to said bottom wall and midway of said side walls.

9. The combination of claim 8 wherein said opening at each of said stations in said first mentioned tray member is in axial alignment with one of said openings in said additional tray member.

10. A carrying case for opened and closed cartridges of viscous material in which the cartridges have a cylindrical body with a dispensing nozzle at one end, the combination of:

a base member having opposed parallel side and end walls and a bottom wall, a first tray member supported in said body member in parallel spaced relation in said bottom wall, a second tray member supported above said first tray member in parallel spaced relation to said first tray member, a plurality of cartridge supporting stations each formed by a pair of aligned openings, one opening of said pair of aligned openings being formed by said second tray member and the other of said openings being formed by said first tray member and being smaller than said opening in said second tray member, said stations each receiving cartridges in a selected one of two positions with the nozzle pointing upwardly or with the nozzle pointing downwardly.

11. The combination of claim 10 further comprising tool carrying compartment formed by said second tray member.

12. The combination of claim 10 wherein said tray members are removable from said base member.

* * * * *

UNITED STATES PATENT AND TRADEMARK OFFICE

CERTIFICATE OF CORRECTION

PATENT NO. : 6,000,540

DATED : Dec. 14, 1999

INVENTOR(S) : Kevin L. Larson

It is certified that error appears in the above-identified patent and that said Letters Patent are hereby corrected as shown below:

Front Page, Related U.S. Application Data - Replace " Aug. 7, 1994." with --Aug. 7, 1997--.

Coulmn 3, line 54 - Replace "on" with --one--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*